US005279441A

United States Patent [19]

Featherall

[11] Patent Number: 5,279,441

[45] Date of Patent: Jan. 18, 1994

[54] WASTE MATERIAL STORAGE AND BALING BIN

[76] Inventor: J. Ronald Featherall, 712 Lincoln Ave., Jermyn, Pa. 18433

[21] Appl. No.: 959,335

[22] Filed: Oct. 13, 1992

[51] Int. Cl.[5] ..... B65D 6/16

[52] U.S. Cl. ..... 220/485; 220/491

[58] Field of Search ..... 220/491, 485

[56] References Cited

U.S. PATENT DOCUMENTS 2,697,540 12/1954 Malliaris ..... 220/491
4,180,277 12/1979 Romero ..... 220/485
4,244,485 1/1981 Trammell ..... 220/485

FOREIGN PATENT DOCUMENTS 74367 11/1960 France ..... 220/491
1200498 7/1970 United Kingdom ..... 220/491

*Primary Examiner*—Joseph Man-Fu Moy

[57] ABSTRACT

A method of storing, compacting and baling loose waste or recyclable materials such as: corrugated cardboard, paper, foam products, fiberglass wool, wood strips, plastic strips, etc.

The device being of a lightweight, tubular, rectilinear construction of varied size, thus enabling the user to quickly and easily apply strapping or binding material through a system of semicircular linear troughs around the contents of the device and compress the waste or recyclable materials into a bale of desired size to facilitate shipping and storage.

2 Claims, 2 Drawing Sheets

WASTE MATERIAL STORAGE AND BALING BIN

BACKGROUND OF THE INVENTION

Many loose and lightweight materials present a storage and handling problem due to their bulk. Compression and compaction of said materials can significantly reduce the bulk and provide for ease of handling and storage.

The necessity to recycle various materials has provided a need for compacting such materials into convenient bales of various sizes to provide ease in handling and shipping.

Often the receivers of such recyclable materials specify a maximum bale size. As an example, a recycler of corrugated cardboard may require bales of a size no greater than 4 ft.×4 ft.×4 ft. Waste materials which often necessitate baling to improve storage and handling are: corrugated cardboard, paperboard, paper, plastic strips, plastic vessels, plastic sheeting, wood strips, waste building materials; such as vinyl siding strips, paper, paper bags, foam insulation, fiberglass batts, etc. A necessity to bale such materials on a small scale is often found in small factories, retail stores, restaurants, construction sites, farms and in the home.

Often agricultural products must be baled. These may include such materials as: Plant stocks, cane stocks, shrubs, limbs, twigs, and long grasses.

SUMMARY OF THE INVENTION

It is the primary objective of this invention to provide an economical method of compaction and baling such materials into various size bales as necessitated by the user of the device.

The device is of simple and lightweight design, thus enabling an extremely cost effective method of producing the necessary bales. There is no need for expensive special equipment or machinery to be used in the compaction or securing of the bale.

The bale may be secured with rope, cable, twine, wire or steel or plastic strapping material. The strapping material method being the most common and most efficient method. The amount of compaction applied to the bale being determined by the amount of tension applied to each strap and the number of straps being applied to the bale. This tension may be applied by hand or more appropriately with the assistance of a strapping tensioner as commonly used for strapping cartons and bundles.

BRIEF DESCRIPTION OF THE DRAWINGS

This invention will be further understood as to its preferred embodiment and preferred method of operation by those skilled in this art form from the attached drawings in which.

DESCRIPTION OF THE PREFERRED EMBODIMENT

Figure 1:
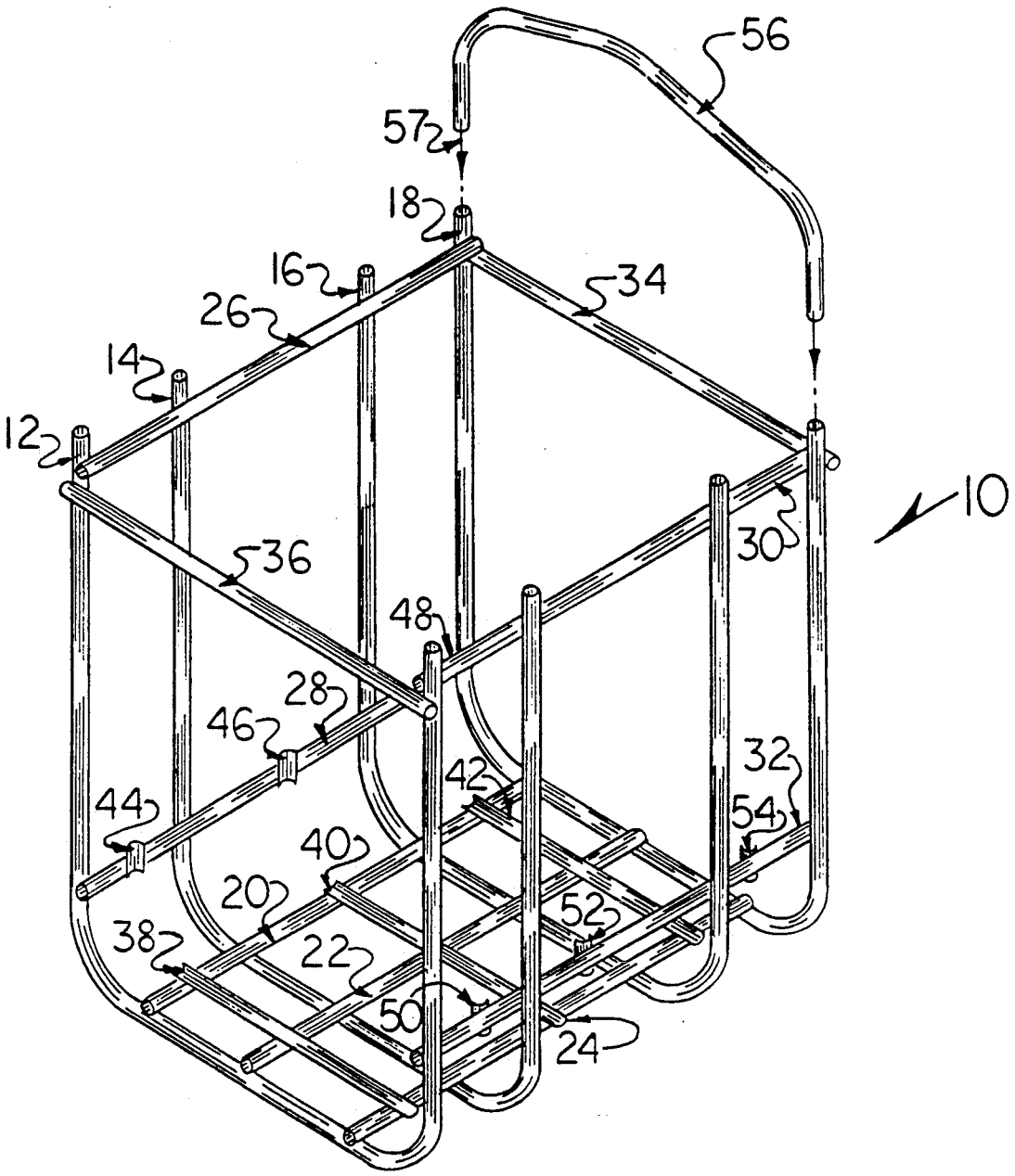
FIG. 1 is a perspective view of the preferred form of a waste material storage and baling bin shown along with one of a plurality of roof ribs applied at its appropriate location.

Referring to the drawings, a waste material storage and baling bin generally designated at 10 constructed in accordance with the preferred rectilinear form consisting of a plurality of tubular "U" shaped ribs 12, 14, 16, 18 heretofor referred to as "U" shaped ribs, with the open end of the "U" being slightly wider than the closed end, and flat at the bottom of the "U".

Figure 2:
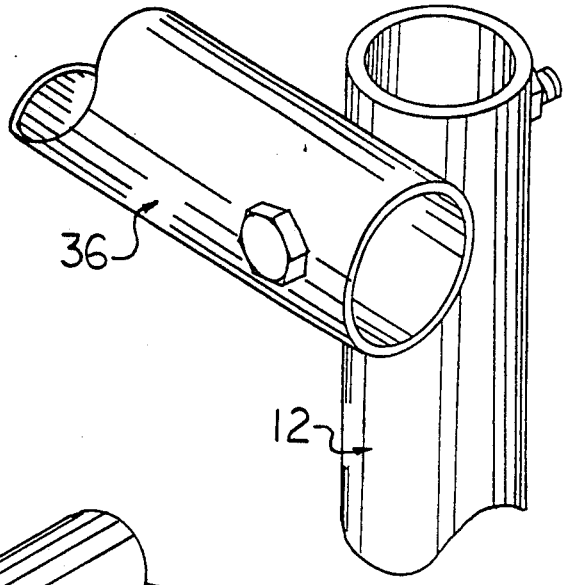
FIG. 2 is a fragmentary perspective view of the preferred method of fastening by nut and bolt, the removable tubular members of said bin.
Figure 3:
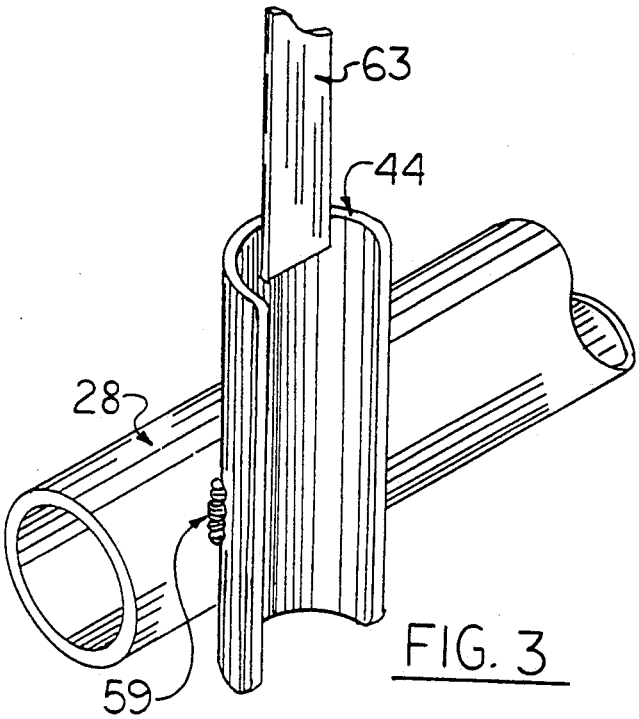
FIG. 3 is a fragmentary perspective view of the preferred method of fastening the vertical tubular troughs to the tubular frame, and also illustrating the insertion of strapping used to compact and restrain the bale of waste material.
Figure 4:
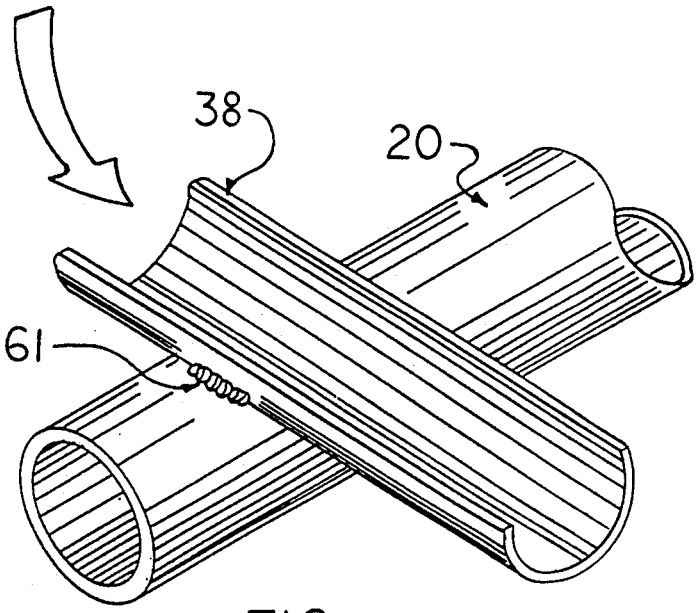
FIG. 4 is a fragmentary perspective view of the preferred method of fastening the horizontal tubular troughs to the tubular frame of said device and also in conjunction with FIG. 3 illustrating the continuing of the strapping, shown in FIG. 4 around said bale.

The "U" shaped ribs are connected to a plurality of longitudinal tubes 20, 22, 24 placed perpendicular to and tangental to each "U" shaped rib on the base of each rib, thus forming the floor of the bin. Also a plurality of longitudinal tubes 26, 28, 30, 32 are placed perpendicular to and tangental to and at the interior of the "U" shaped ribs forming the sides of the bin. Longitudinal tubes 34, 36 are placed perpendicular to and tangentat to both extremities of the "U" shaped rib at either end of the bin and applied externally. Tubes 34, 36 are fastened with a ¼-20 bolt with nut at each extremity as shown in FIG. 2. All other intersections of afforsaid tubing will be welded as designated by 59, FIG. 3 and 61, FIG. 4. Semicircular longitudinal members 38, 40, 42 are constructed from thin wall tubing of 1" diameter by splitting the tubing across its centerline throughout its length, thus producing two semicircular troughs heretofor referred to as horizontal guide troughs. The horizontal guide troughs are placed with convex side in contact with longitudinal members 20, 22, 24 and perpendicular to and tangent to members 20, 22, 24 and extending beyond these members approximately 4 inches as indicated in FIG. 4. These horizontal guide troughs are spaced along members 20, 22, 24 at an equal distance between and parallel to each pair of "U" shaped ribs. That is: trough 38 is equally distant between rib 12 and rib 14, trough 40 is equally distant between rib 14 and rib 16 and so on.

Similar guide troughs 44, 46, 48, 50, 52, 54 of a shorter length of approximately 2 inches are placed vertically along longitudinal members 28 and 32 with convex side in contact with and tangent to and perpendicular to members 28 and 32 and facing toward the interior of said bin and also spaced at an equal distance and parallel to each pair if "U" shaped ribs, heretofor referred to as vertical guide troughs. Each pair of vertical guide troughs is therefore in line and in the same vertical plane with its respective horizontal guide trough. FIG. 3 and FIG. 4.

Tubular member 56 heretofor referred to as a roof rib is constructed of a similar tubing of a lesser diameter, thus allowing its ends to enter and exit the ends of a "U" shaped rib as shown by 57. Accordingly a roof rib may be inserted into each "U" shaped rob in such a manner as to provide a framework to support an impervious covering such as a tarpaulin to be deployed when the bin is to be stored or used out of doors as to prevent rain from entering the bin. Of course this roof is optional and may not be necessary when used in doors.

The above description of a specific embodiment of the bin 10 is not meant to limit the invention to that specific description nor size but is meant for illustrative purposes only.

In use a worker can store material which is to be baled, heretofor referred to as waste material, in said bin by stacking or simply by throwing the waste material into the bin until a desired amount has been retained. The means for baling is then chosen. As for an example the most common shall heretofor be considered steel or plastic strapping tensioned with a strapping tensioning device.

The strapping material 63 in FIG. 3 is first fed downward through one of the vertical guide troughs 44. The strapping is then turned 90° to a horizontal direction and passed through horizontal trough 38 as designated by the arrow FIG. 4. The strapping is then continued horizontally across the bottom of the bale being formed, then turned again 90° to a vertical direction and upwards through vertical trough 50. The strapping is then continued upward to the top of the bale and turned again 90° to a horizontal direction over the top of said bale and once again turned 90° in a downward direction along the vertical side of the bale to its origin. It is at this location the strapping is fitted into a tensioner, tension applied and compaction of the bale begins. The strap is then secured in the appropriate manner.

The afforsaid process is continued at the appropriate locations along the bin until the desired compaction is reached and a bale is formed. However the initial strapping for each bale may be more appropriately affixed at the center of the binfor ease of operation. When all parallel straps are applied the tubular members 34 or 36 may be removed to enable the user to roll the compacted bale from the bin. To form a more concise bale an additional strap may be applied to the bale perpendicular to those previously affixed thus completing the bale.

It is hereby claimed:

1. A waste material storage and bailing bin constructed in accordance with the preferred rectilinear form comprising a plurality of three-sided tubular ribs with the two adjacent sides being at a slightly obtuse angle to the base and all sides lying in the same plane, thus the open end of the rib being slightly wider than the closed end; a plurality of longitudinal tubular members fastened perpendicular to and tangential to and at the interior of the three-sided ribs forming the sides of the bin; a plurality of logitudinal tubular members fastened perpendicular to and tangential to and at the interior of the three-sided ribs forming the bottom of the bin; a singular longitudinal tubular member fastened by removable means, perpendicular to and tangential to both extermities of the three-sided rib at either end of the bin and applied externally; a plurality of semi-tubular longitudinal members fastened with the convex surface in contact with and perpendicular to and tangential to each of the bottom longitudinal members, and extending beyond the extermities of the bottom longitudinal members fastened with the convex surface in contact with and perpendicular to and tangential to each of the side longitudinal members, except for the uppermost side member on each side, and within the vertical plane formed by each of the semi-tubular bottom longitudinal members.

2. A waste material storage and baling bin according to claim 1 wherein a plurality of curved tubular members of sufficient diameter to allow its ends to enter and exit the ends of each "U" shaped tubular rib simultaneously, thus forming a framework for a top cover.

* * * * *